United States Patent [19]

Urmson, Jr. et al.

[11] Patent Number: 4,928,600

[45] Date of Patent: May 29, 1990

[54] RAILROAD SPIKE HOLDING APPARATUS WITH ACUTE ANGLED JAWS

[75] Inventors: William T. Urmson, Jr., Bakerstown; Emeric Gaslevic, Glenshaw; Ronald K. Junk, Sarver, all of Pa.

[73] Assignee: Harsco Corporation, Wormleysburg, Pa.

[21] Appl. No.: 272,616

[22] Filed: Nov. 17, 1988

[51] Int. Cl.[5] ..... E01B 29/24

[52] U.S. Cl. ..... 104/17.1

[58] Field of Search ..... 104/17.1, 17.2, 2; 173/92; 227/124, 147, 155

[56] References Cited

U.S. PATENT DOCUMENTS 1,856,893 5/1932 Talboys ..... 104/17.1

4,273,052 6/1981 Woolner et al. ..... 104/17.1

*Primary Examiner*—Robert J. Oberleitner

*Attorney, Agent, or Firm*—Kerkam, Stowell, Kondracki & Clarke

[57] ABSTRACT

Apparatus for holding a railroad spike in a substantially vertical position while the spike is being driven into a railroad tie. The spike holding apparatus includes a support member adapted to connect said apparatus to a railroad spiking machine, a pair of jaws which rotatably depend from said support member at an angle to the plane of the rail which angle is large enough to avoid interference with rail anchors but not so large as to preclude sufficient mechanical leverage from being imposed on the spike to be held and actuators to to rotate said jaws relative to said support member and to one another. The first jaw of said pair includes a cradle adapted to receive a spike and further adapted to avoid interference with the spike after it is driven. The second jaw of said pair includes contact surfaces adapted to force a spike into the cradle of the first jaw and hold it down until said spike is driven into the tie.

20 Claims, 6 Drawing Sheets

RAILROAD SPIKE HOLDING APPARATUS WITH ACUTE ANGLED JAWS

BACKGROUND OF THE INVENTION

1. Field of the Invention

The present invention relates to apparatus for holding railroad spikes while they are being mechanically driven into a railroad tie and more particularly, to apparatus for holding railroad spikes while they are being driven by impact-type spike drivers.

2. Description of the Prior Art

In the construction of railroad tracks, rails rest on tie plates which in turn rest on wooden ties. The ties are oriented transversely to the track and are laid in ballast of various types. Tie plates consist of rectangular metal plates which generally have eight holes through which spikes may be driven into the tie. The plates are positioned over the tie and underneath each rail such that four of the holes for spikes are on each side of the rail. The holes closest to the rail are for spikes which hold the rails to the proper gauge. These are referred to as line spikes. The other holes in the tie plates are located further from the base of the rail and are for spikes which can further anchor the tie plate to the tie. These are referred to as anchor spikes.

In order to hold the rail against longitudinal movement, rail anchors are also frequently provided. Rail anchors come in various forms. These consist of a clip-like piece of metal which fits tightly around the base of the rail. In most forms, a portion of the rail anchor projects upward from the outer edge of the base of the rail and inward toward the web of the rail. The rail anchors are fitted onto the rail immediately adjacent to the ties so that the rail cannot move longitudinally relative to the tie.

The process of laying rail and then spiking that rail to gauge has seen many advances over the years. Principally, these developments have come in the form of track mounted machines designed to automate the process of driving spikes, either in the context of laying down completely new rail or in the context of replacing some or all of the ties in a particular section of track.

Among the most successful of these machines is the one disclosed in U.S. Pat. No. 4,273,052. This machine provides for rapid and accurate driving of spikes in both new and replacement/repair operations. Machines having other arrangements, by way of example, are shown in U.S. Pat. Nos. 4,131,067; 3,717,101; 3,257,962 and 3,120,195.

Common to these machines is a mechanism for holding a spike in a substantially upright position just before and while it is being driven into the tie. In U.S. Pat. No. 4,273,052, the spike is held by a pair of jaws which rotatably depend from a support member. One jaw rotates in a plane parallel to the rail and the other rotates in the plane which is at an angle of approximately 45 degrees from the vertical plane of the rail. The jaws are rotated into holding relationship with the spike by pneumatic cylinders and are rotated away from the spike by springs which take over when the pneumatic cylinders are deenergized.

In U.S. Pat. No. 4,131,067, the spike is held by a magnetic holder in connection with a channel-like device. U.S. Pat. No. 3,717,101 discloses a spike holder consisting of a pair of jaws which rotate toward one another in a horizontal plane and grip the spike pincher-like from the side. U.S. Pat. No. 3,257,962 also shows a magnetic spike holder which is attached to a spike driving hammer. U.S. Pat. No. 3,120,195 shows a pronged holder designed to carry a spike between two fork-like prongs to a vertically displaced magnetic plate which then steadies the spike in a vertical orientation preparatory to its being struck by a hammer.

In the laying of new rail, there has been a trend in the railroad industry in recent years to install rail anchors to the rail base as the rail is being laid and before it is line-spiked. This is in part a result of the substantially increased use of continuous welded rail (CWR) and the need to hold such rail against longitudinal movement. Longitudinal movement of such rail can occur because of expansion or contraction due to temperature changes or other reasons. These factors arise both during the rail laying process and after the CWR has been fully laid and spiked. It has therefore become increasingly common for rail anchors to be applied to the rail before line spiking.

Further, there has been a trend in the railroad industry toward use of impact-type spike drivers. This trend has occurred in part because impact-type spike drivers can be used more advantageously with used spikes which are often bent from prior service. Impact-type spike drivers have the further advantage of being able to fully drive a spike into a tie without the need to have the machine to which the spike driver is attached anchored to the rail by rail grippers as is shown and claimed in U.S. Patent No. 4,273,052.

As a result of these trends, there is a need for an apparatus which will hold spikes while they are being driven into the tie and which will not interfere with or dislodge the rail anchors which are already in place. These trends have also led to a need for a spike holder which can grip spikes firmly while they are being sequentially impacted by an impact-type spike driver until inserted into the tie at least a sufficient distance to permit complete driving of the spike. It is also important for such a spike holder to be able to firmly hold onto spikes even if they are hammered before the spike chisel is inserted into the appropriate hole in the tie plate and to firmly grip spikes which are bent or otherwise of slightly non-standard cross-section. Prior art devices are unable to meet these needs. In most of the prior art devices, the mechanism by which the spikes are held is either of insufficient strength to hold the spike while it is being hammered by an impact-type spike driver or in operation directly interferes with rail anchors in place at the time of spiking.

SUMMARY OF THE INVENTION

The present invention provides an apparatus for holding a railroad spike in a substantially vertical position while the spike is being driven into a railroad tie. It is advantageous for holding spikes while being driven in connection with rails on which rail anchors were installed prior to the spiking operation. It is likewise advantageous for holding spikes being driven by an impact-type spike driver. It is further advantageous for use with used spikes. The apparatus includes a support member and a pair of jaws pivotally connected to depend from the support member. The pivot connection between the support member and the jaws is arranged so that each of the jaws pivots in a substantially vertical plane which is at an angle to the vertical plane of the rail. This angle is great enough to avoid interference between the jaw and any rail anchors when the jaw is rotated out of contact with a spike but is small enough to permit the jaws to impose sufficient mechanical leverage on a spike to firmly hold it while it is being driven into a tie. This angle is usually about 45 degrees for each jaw. The apparatus includes actuators, preferably hydraulic actuators, to independently rotate each of the jaws into and out of contact with a spike. One of the jaws has a cradle formed at its tip which is adapted to receive and hold a spike when the jaw is rotated toward it and into contact with a spike and is further adapted to avoid interference with the spike itself as it is being rotated out of contact with the spike. The cradle can consist of a first face oriented parallel to the rail, a second face oriented perpendicular to the rail and a third face oriented substantially in the plane of rotation of the jaw. The opposite jaw has contact surfaces adapted to force the spike into and hold it in the cradle of the first jaw when it is rotated into contact with a spike. These contact surfaces can consist of a curved or cylindrical contact surface, the axis of which is perpendicular to the rail and a contact plate having a flat cross-section and oriented substantially in the plane of rotation of the jaw.

Accordingly, the present invention provides an apparatus for holding a railroad spike while it is being driven which solves the problems connected with line spiking rails having rail anchors and overcomes the limitations of the prior art. The present invention further provides an apparatus which firmly holds a spike while being driven by an impact-type spike driver and which will function well with new and used, partially bent spikes. The present invention also provides an apparatus for holding a spike which facilitates far greater visibility on the part of the operator of the apparatus while a spike is held and driven into a tie.

Further objects and advantages of this invention will become apparent as the following description and accompanying drawings are considered.

BRIEF DESCRIPTION OF THE DRAWINGS

The present invention can be better understood by reference to the figures in which.

DETAILED DESCRIPTION OF THE PREFERRED EMBODIMENTS

Figure 1:
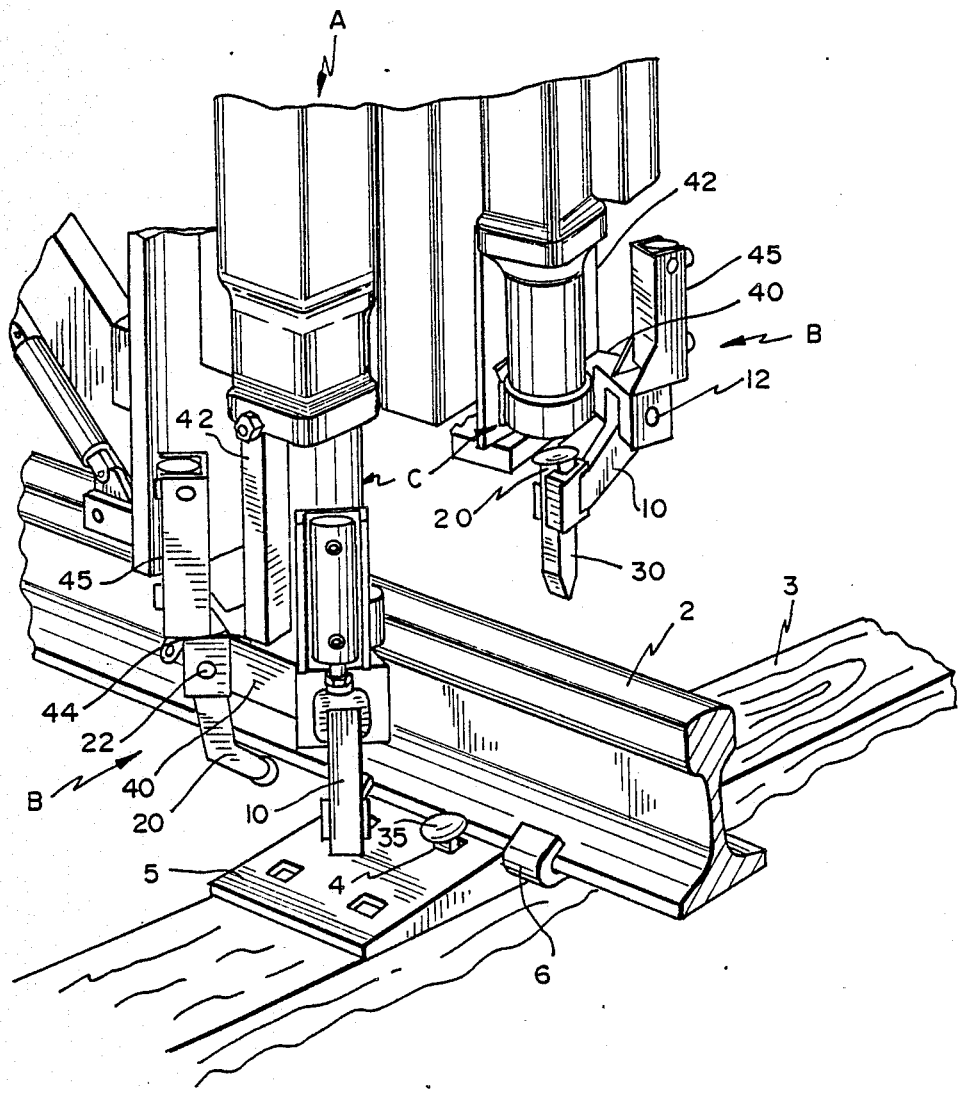
FIG. 1 is a perspective view of a portion of a railroad spiking machine which incorporates the spike holding apparatus of the present invention and impact-type spike drivers.

In accordance with the present invention, there is provided an apparatus for holding a railroad spike in a substantially vertical position while said spike is being driven into a railroad tie. Referring to FIG. 1, there is shown a portion of a railroad spike driving machine A which incorporates the spike holding apparatus B with impact-type spike drivers C. The spike holding apparatus B pictured in FIG. 1 in the background is shown with a pair of jaws 10 and 20 in a closed position holding a spike 30 in a substantially vertical position so that it can be driven into tie 3 by spike driver C. The spike holding apparatus B pictured in FIG. 1 in the foreground is shown with jaws 10 and 20 in the open position after a line spike 35 has been driven through hole 4 in tie plate 5 into tie 3. Also in FIG. 1, a rail anchor 6 is shown immediately next-to tie 3 and in close proximity to line spike 35.

Figure 4:
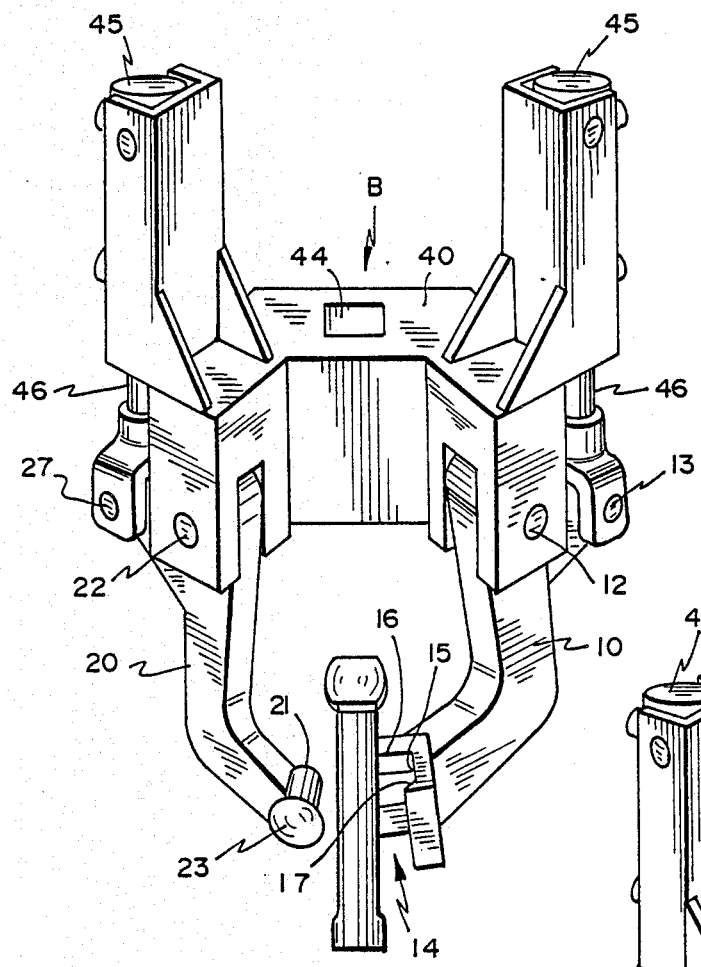
FIG. 4 is a perspective view of the spike holding apparatus in a partially open position after a spike has been partially driven into a tie.
Figure 3:
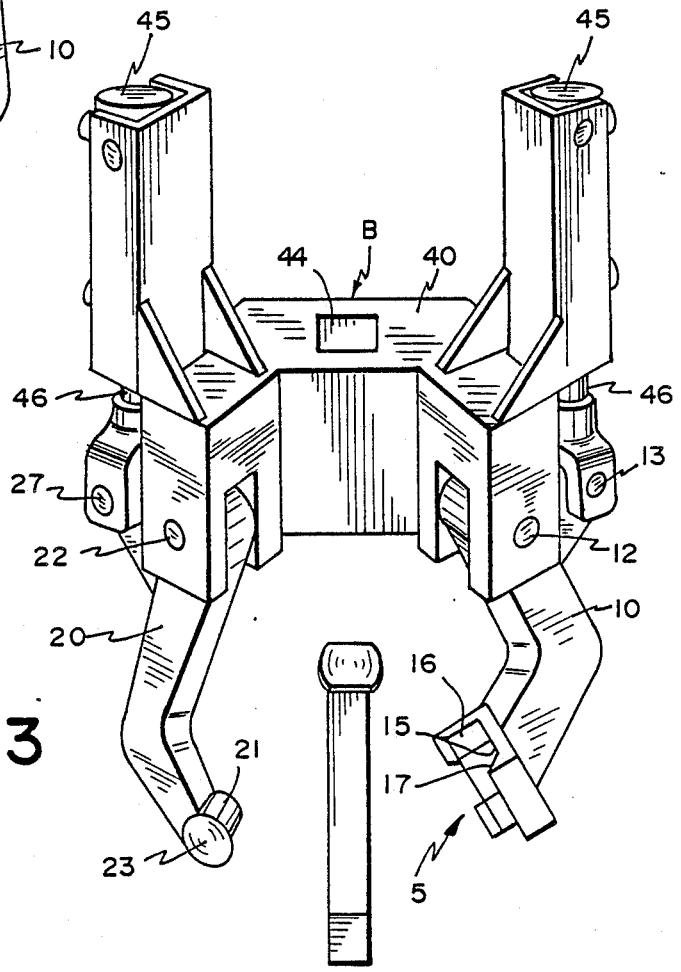
FIG. 3 is a perspective view of the spike holding apparatus in a fully opened position.
Figure 5:
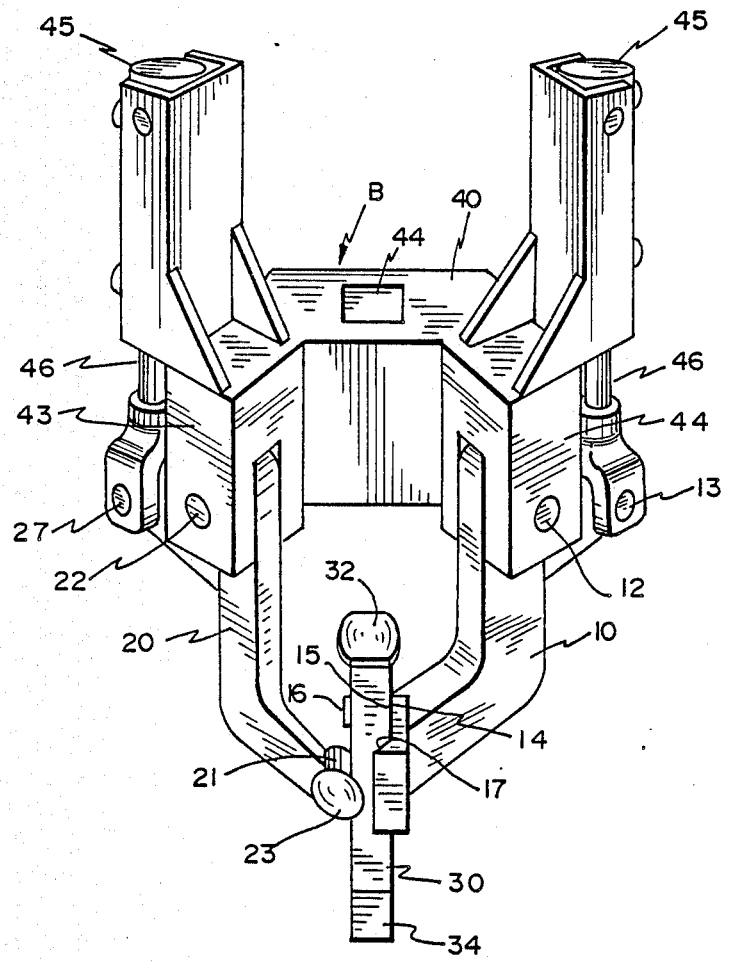
FIG. 5 is a perspective view of the spike holding apparatus in the closed position holding a spike.

Referring further to FIG. 1, and to FIGS. 3, 4 and 5, jaw 10 rotatably depends from support member 40 at pivot 12. Jaw 10 is rotated about pivot 12 and held in gripping relationship with spike 30 by an actuator 45. Actuator 45 is connected to jaw 10 by arm 46 and pivot 13. Pivot 13 is located on shoulder 11 of jaw 10. Actuator 45 is preferably an hydraulic actuator. Jaw 20 similarly rotatably depends from support member 40 at pivot 22. Jaw 20 is rotated about pivot 22 and held in gripping relationship with spike 30 by an actuator 45. Actuator 45 is connected to jaw 20 by arm 46 and pivot 27. Pivot 27 is located on shoulder 26 of jaw 20.

Support member 40 is connected to spike driver C by means of a slide bar 42 which passes through a hole 44 in support member 40. Hole 44 is adapted to slidably receive said slide bar 42. Slide bar 42 is fixed to the frame of spike driver C. Thus, the spike holding apparatus may slide vertically relative to the spike driver on slide bar 42.

Figure 2:
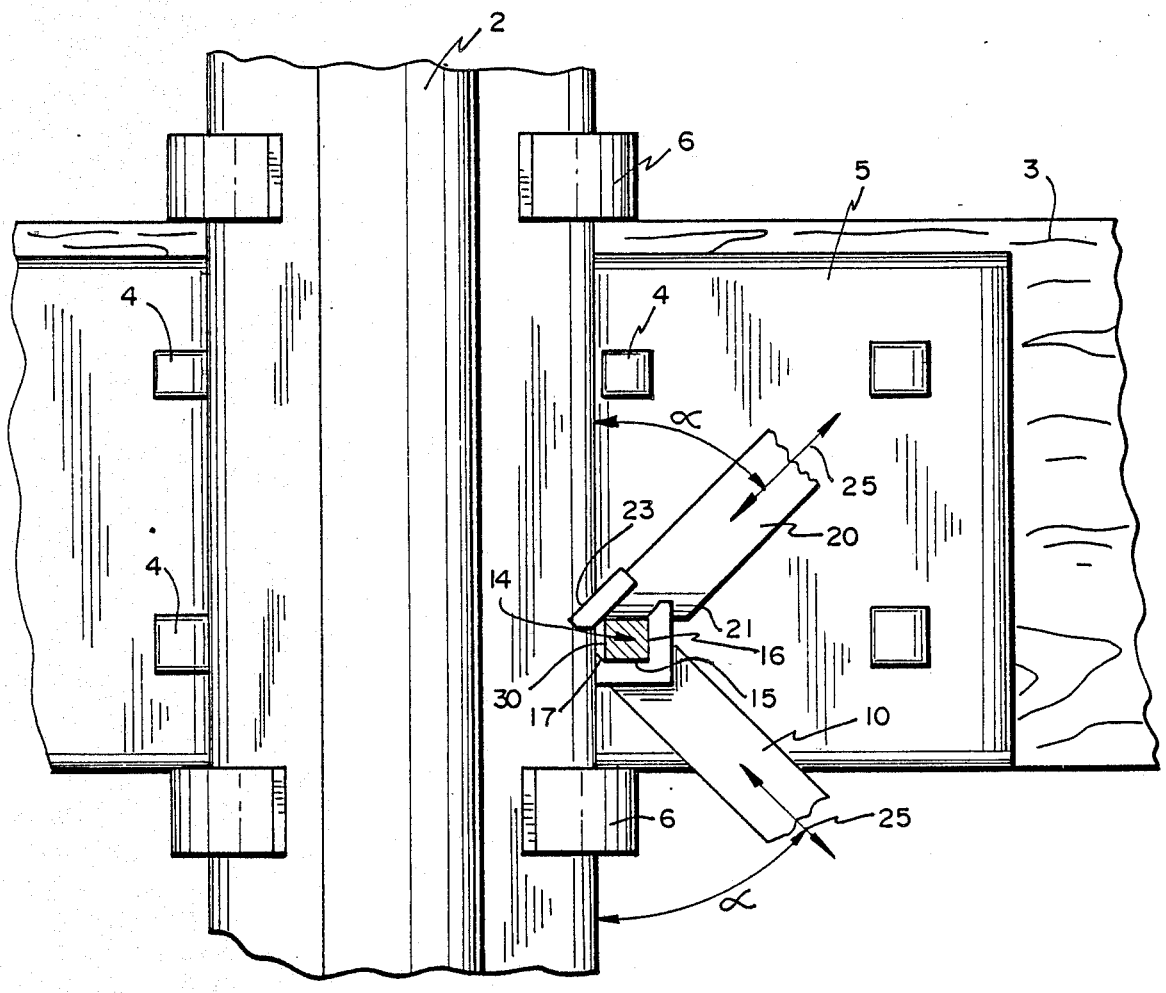
FIG. 2 is a plan view showing the swing path and jaw tip configuration of the spike holding apparatus in relation to a spike, a tie, a tie plate, a rail and rail anchors.

FIG. 2 shows a plan view of jaws 10 and 20 in gripping relationship with spike 30. FIG. 5 shows a perspective view of the spike holding apparatus with jaws 10 and 20 similarly in gripping relationship with spike 30. Spike 30 is held by jaws 10 and 20 for being driven into tie 3 through a linespike hole 4 in tie plate 5. When the edge of tie plate 5 is located next to the same side of tie 3 abutted by a rail anchor 6, as is shown in FIG. 2, it can be seen that unless jaw 10 of the spike holding apparatus is withdrawn from spike 30 at an angle sufficient to clear anchor 6, anchor 6 will interfere with jaw 10. This will either dislodge anchor 6, or, more probably, will prevent full withdrawal of jaw 10 away from spike 30, thereby preventing complete driving of spike 30. Similarly, if the edge of tie plate 5 were located next to the side of tie 3 other than is shown in FIG. 2, it can be seen that unless jaw 20 of the spike holding apparatus is withdrawn at an angle from spike 30 at an angle sufficient to clear anchor 6, anchor 6 will interfere with jaw 20.

Therefore, the spike holding apparatus of the present invention provides an acute angle $\alpha$ included between the planes of rotation 25 of jaws 10 and 20 and the vertical plane of rail 2. Angle $\alpha$ is large enough to avoid interference between rail anchor 6 and jaws 10 and 20 when said jaws are rotated out of contact with spike 30 and away from one another but is not so large as to preclude sufficient mechanical leverage from being imposed on spike 30 by jaws 10 and 20 when they are rotated toward one another and into contact with spike 30. Referring to FIG. 5, angle is provided by angling ends 43 and 44 of support member 40.

In the preferred embodiment of the present invention angle $\alpha$ is about 45 degrees, but may be varied therefrom, said variation being limited by the dual requirement that jaw 10 and 20 not contact rail anchor 6 when rotated out of holding contact with spike 30 and that the mechanical leverage of jaws 10 and 20 be sufficient to firmly grip and hold spike 30 when said jaws are rotated into contact with spike 30. Likewise, the plane of rotation or movement of jaws 10 and 20 is substantially vertical, but may be varied slightly therefrom likewise bearing in mind the above dual requirements.

Figure 6A:
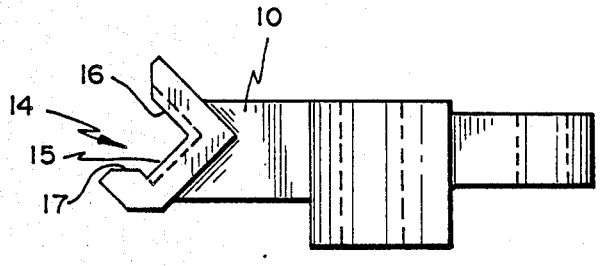
FIG. 6*a* is a plan view of one of the jaws.
Figure 6B:
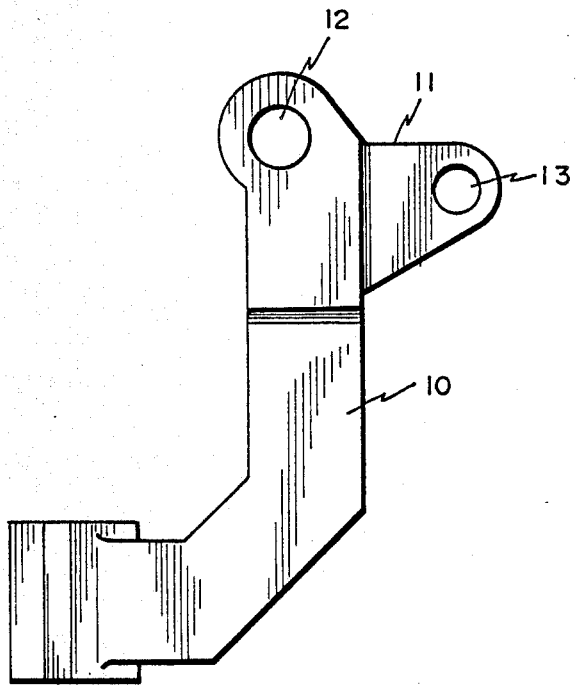
FIG. 6*b* is a side elevational view of the same jaw shown in FIG. 6*a;*
Figure 6C:
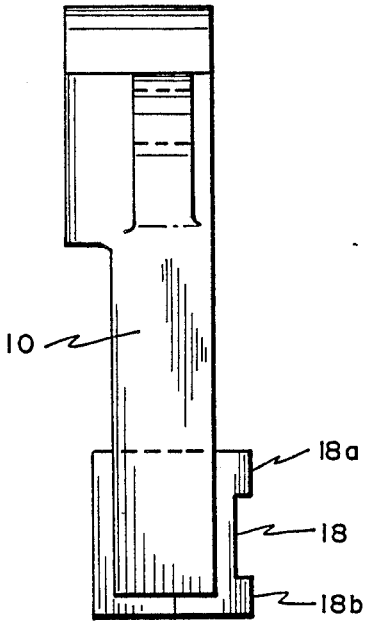
FIG. 6*c* is a front elevational view of the same jaw shown in FIG. 6*a;*

Referring further to FIG. 2, and to FIGS. 6*a*, 6*b* and 6*c*, the tip of jaw 10 is provided with a cradle 14 for receiving spike 30. Cradle 14 consists of faces 15, 16 and 17. Face 15 is oriented perpendicular to the rail, face 16 is oriented parallel to and facing the rail, and face 17 is oriented substantially parallel to the plane of rotation 25 of jaw 10. In the preferred embodiment, faces 15 and 16 are provided with a recess 18 such that only the upper ridge 18*a* and lower ridge 18*b* of faces 15 and 16 contact the sides of spike 30.

Figure 7A:
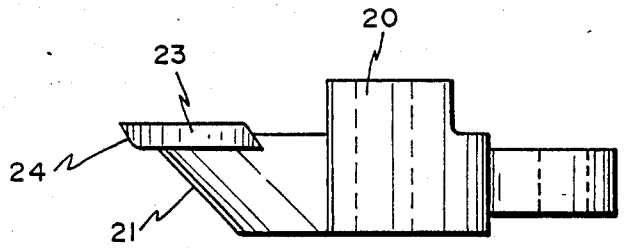
FIG. 7*a* is a plan view of the other jaw.
Figure 7C:
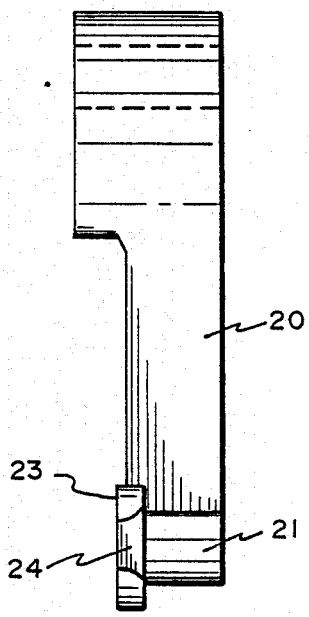
FIG. 7*c* is a front elevational view of the same jaw shown in FIG. 7*a*.
Figure 7B:
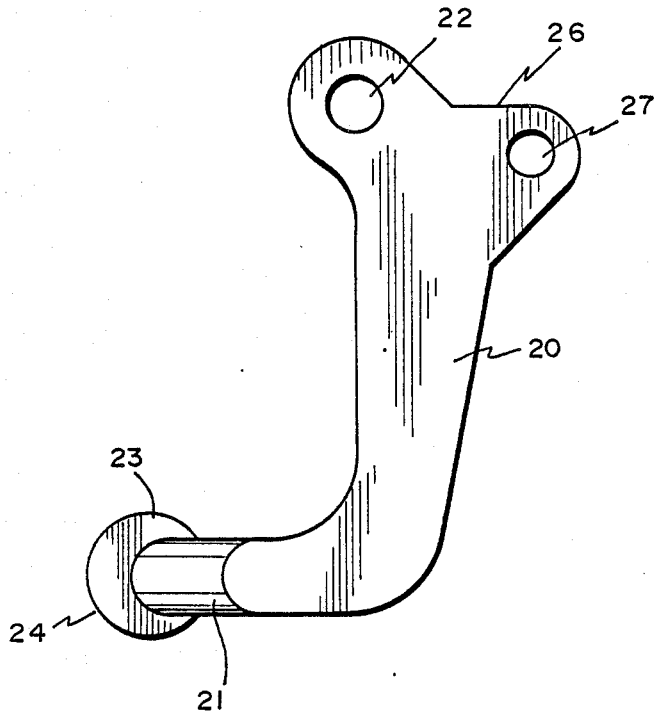
FIG. 7*b* is a side elevational view of the same jaw shown in FIG. 7*a*.

Referring further to FIG. 2, and to FIGS. 7*a*, 7*b* and 7*c*, the tip of jaw 20 is provided with a generally curved and preferably cylindrical contact surface 21 and an angled contact plate 23. The axis of surface 21 is oriented perpendicular to the rail. As such, it is also parallel to face 15 of cradle 14 of jaw 10. The length of jaw 20 is adjusted so that surface 21 is intermediate upper and lower ridges 18*a* and 18*b* of faces 15 and 16 of cradle 14 in jaw 10. Spike 30 is thus held by surface 21 on one side and by upper and lower ridges 18*a* and 18*b* of faces 15 and 16 on the other when the jaws are rotated into contact with spike 30. With this arrangement, even bent or irregular spikes can be held firmly while being driven into a tie.

Plate 23 is generally of flat cross section and of circular plan form. Plate 23 is attached to the end of surface 21 and is oriented substantially parallel to the plane of rotation 25 of jaw 20. Plate 23 has a rounded bevel 24 on its forward most edge adapted so that when jaw 20 is rotated into contact with spike 30, bevel 24 of plate 23 will contact spike 30 on its corner and force said spike squarely and firmly in cradle 14 of jaw 10. The spike can then be held firmly between the tips of jaw 10 and jaw 20 even while being sequentially hammered by an impact-type spike driver.

Referring to FIGS. 1 through 5, the operation of the spike holding apparatus of the present invention is as follows. Spike holding apparatus B is positioned to receive a spike 30 from a spike supply mechanism (not shown) such as the one shown in U.S. Pat. No. 4,273,052. With this mechanism, jaw 10 is first lowered to its receiving position by actuator 45. Jaw 10 is shown in its receiving position in FIG. 5. Spike 30 is then positioned in cradle 14 of the tip of jaw 10 by the spike supply mechanism. Then jaw 20 is rotated by actuator 45 into contact with spike 30. The action of the angled contact plate 23 and bevel 24 when it first contacts spike 30 and the guidance provided by face 17 of jaw 10 force spike 30 firmly into cradle 14. Concurrent therewith, surface 21 firmly contacts spike 30 and holds it against face 15 of jaw 10. In the preferred embodiment, surface 21 contacts spike 30 and holds it in contact with upper and lower ridges 18*a* and 18*b*. Further, actuators 45 maintain their full force of rotation on jaws 10 and 20 so that gripping force is imposed by jaws 10 and 20 on spike 30. Thus, spike 30 is prevented from lateral movement along the axis of the rail by the gripping force between surface 21 and upper and lower ridges 18*a* and 18*b* on face 15. Further, spike 30 is prevented from lateral movement along the axis perpendicular to the rail by the frictional forces on these contact surfaces and by the configuration of plate 23 on jaw 20 and face 17 on jaw 10 which cooperate to force and hold spike 30 against face 16 of jaw 10.

Once spike 30 has been firmly grasped as described above, the spike holding apparatus is lowered and maneuvered so as place the chisel end 34 of spike 30 in the appropriate hole of the tie plate. Once the spike has been so located, the spike driving apparatus is brought into contact with the head 32 of spike 30 and the process of driving spike 30 into the tie is begun. After the spike has been partially inserted or driven into the tie, generally sufficiently far enough to resist lateral movement of head 32 while being driven further into the tie, jaws 10 and 20 are rotated out of contact with spike 30. Because the plane of rotation of each jaw is at an angle to the vertical plane of the rail, this rotational action of each jaw avoids any interference with any rail anchors. Likewise, because of the configuration of the tips of jaws 10 and 20, both can be rotated out of contact with spike 30 without dislodging or otherwise disturbing spike 30 from its state of partial insertion into a tie.

The spike holding apparatus of the present invention may be operated manually or automatically. When operated manually, the jaws may be opened or closed by actuating a switch located near the operator of the spike driving machine on which the spike holding apparatus is installed. This switch controls actuators 45 and is either in an opened or closed position. When the switch is in the opened position, actuators 45 open the jaws by rotating them away from one another, away from the spike and holding them in that position. When the switch is in the closed position, actuators 45 close the jaws by rotating them toward one another, toward the spike and holding them in gripping contact with the spike.

When operated automatically, the jaws are opened or closed by actuation of various limit switches, the set points of which may be adjusted to operate at particular points in connection with operation of a spike driver and a spike supply mechanism on the spike driving machine. When operated in this fashion, the spike driver is raised as if it has just driven a spike. This closes a limit switch which causes actuator 45 to rotate jaw 10 of the spike holding apparatus into the position for receiving a spike and which causes a spike supply mechanism to deliver a spike into cradle 14 of jaw 10. Delivery of the spike into cradle 14 of jaw 10 by the spike supply mechanism closes another limit switch which causes jaw 20 to rotate toward jaw 10 and into gripping contact with spike 30, thereby forcing spike 30 firmly into cradle 14 of jaw 10 and holding spike 30 between surfaces 21 and 23 of jaw 20 and surfaces 15, 16 and 17 of cradle 14 of jaw 10. This also causes the spike supply mechanism to be withdrawn. The operator then causes spike driver C and spike holding apparatus B to which it is connected to be lowered toward tie 3 and tie plate 5. This movement is then stopped at a preset distance above tie plate 5 by another limit switch. The preset distance above tie plate 5 at which spike driver C stops is adjustable. Then the operator manually spots chisel end 34 of spike 30 over the appropriate hole 4 in tie plate 5. The operator then causes the spike driver to engage the head 32 of spike 30 and to begin driving spike 30 into tie 3. Once spike 30 has been driven partially into tie 3 a preset distance, another limit switch is closed which causes jaws 10 and 20 open, thereby allowing the spike driver to drive spike 30 further into tie 3. This preset distance is also adjustable. As the spike driver drives spike 30 into the tie, jaws 10 and 20 of the spike holding apparatus B come in contact with tie plate 5 and this contact forces spike holding apparatus B to slide on the slide bar 42, thereby permitting the spike driver to fully drive spike 30 into tie 3. The operator then raises the spike driver, which also raises spike holding apparatus B, and the process is begun again.

It will be understood that various changes in the details, materials and arrangements of parts which have been herein described and illustrated may be made by those skilled in the art within the principle and scope of the invention as expressed in the appended claims.

What is claimed is:

1. Apparatus for holding a railroad spike in a substantially vertical position while said spike is being driven into a railroad tie supporting at least one railroad rail which is being restrained against longitudinal movement by at least one rail anchor attached to said rail in abutting relationship with said tie, said apparatus being supported in a railroad spiking machine, comprising: a support member; a pair of jaws, each jaw pivotally connected to depend from said support member and to pivot in a substantially vertical plane located at an acute angle $\alpha$ to the vertical plane of the rail, said angle $\alpha$ being great enough to avoid interference between said jaws and said anchor when said jaws are pivoted out of contact with said spike and said angle $\alpha$ being small enough to impose sufficient mechanical leverage to firmly hold said spike when said jaws are pivoted into contact with said spike; means to rotate said jaws relative to said support member and relative to each other; the first jaw of said pair of jaws having a cradle formed therein adapted to receive a spike and further adapted to avoid interference with said spike after said spike has been partially driven into a tie and said first jaw is pivoted out of contact with said spike; and the second jaw of said pair of jaws having contact surfaces adapted to contact said spike so as to force it into said cradle and to firmly hold said spike in said cradle.

2. The apparatus claimed in claim 1 in which said angle $\alpha$ is approximately 45 degrees.

3. The apparatus claimed in claim 1 in which the means to rotate said jaws is comprised of hydraulic cylinders.

4. The apparatus claimed in claim 1 in which the cradle of the first jaw of said pair of jaws is comprised of a first face which is oriented parallel to the rail, a second face which is oriented perpendicular to the rail, and a third face which is oriented substantially parallel to the plane of rotation of said jaw and the contact surfaces of the second jaw of said pair of jaws is comprised of a cylindrical contact surface the axis of which is perpendicular to the rail and a contact plate at one end of said cylindrical contact surface which is oriented substantially in the plane of rotation of said jaw.

5. The apparatus claimed in claim 1 in which said support member is slidably connected to a spike driver by means of a hole in said support member which hole is adapted to receive a vertically oriented slide bar which is fixed to said spike driver.

6. The apparatus claimed in claim 1 wherein the acute angle corresponding to the substantially vertical plane in which the first jaw pivots is equal to the acute angle corresponding tot he substantially vertical plane in which the second jaw pivots.

7. Apparatus for driving a railroad spike comprising: a rail mounted frame means, a spike driver connected to said frame means, a support member connected to said spike driver, a pair of jaws, each jaw pivotally connected to depend from said support member and to pivot in a substantially vertical plane located at an acute angle $\alpha$ to the vertical plane of the rail, said angle $\alpha$ being great enough to avoid interference between said jaws and said anchor when said jaws are pivoted out of contact with said spike and said angle $\alpha$ being small enough to impose sufficient mechanical leverage to firmly hold said spike when said jaws are pivoted into contact with said spike; means to rotate said jaws relative to said support member and relative to each other; the first jaw of said pair of jaws having a cradle formed therein adapted to receive a spike and further adapted to avoid interference with said spike after said spike has been partially driven into a tie and said first jaw is pivoted out of contact with said spike; and the second jaw of said pair of jaws having a contact surface adapted to contact said spike so as to force it into said cradle and to firmly hold said spike in said cradle.

8. The apparatus in claim 7 in which said angle $\alpha$ is approximately 45 degrees.

9. The apparatus in claim 7 in which the means to rotate said jaws is comprised of hydraulic cylinders.

10. The apparatus claimed in claim 7 in which the cradle of the first jaw of said pair of jaws is comprised of a first face which is oriented parallel to the rail, a second face which is oriented perpendicular to the rail, and a third face which is oriented substantially parallel to the plane of rotation of said jaw and the contact surfaces of the second jaw of said pair of jaws is comprised of a cylindrical contact surface the axis of which is perpendicular to the rail and a contact plate at one end of said cylindrical contact surface which is oriented substantially in the plane of rotation of said jaw.

11. The apparatus claimed in claim 7 in which said support member is slidably connected to said spike driver by means of a hole in said support member which hole is adapted to receive a vertically oriented slide bar which is fixed to said spike driver.

12. The apparatus claimed in claim 7 in which said spike driver is an impact-type spike driver.

13. The apparatus claimed in claim 7 wherein the acute angle corresponding to the substantially vertical plane in which the first jaw pivots is equal to the acute angle corresponding to the substantially vertical plane in which the second jaw pivots.

14. Apparatus for holding a railroad spike in a substantially vertical position while said spike is being driven into a railroad tie supporting at least one railroad rail which is being restrained against longitudinal movement by at least one rail anchor attached to said rail in abutting relationship with said tie, the combination comprising: a support member adapted for slidable connection to a spike driver connected to a spike driving machine; a pair of jaws, each jaw pivotally connected to depend from said support member and to pivot in a vertical plane located at an angle of approximately 45 degrees to the vertical plane of the rail, a pair of hydraulic actuators connected to said support member for rotating said jaws relative to said support member and relative to each other; the first jaw of said pair of jaws having a cradle formed therein which comprises a first face which is oriented parallel to the rail, a second face which is oriented perpendicular to the rail, and a third face which is oriented substantially parallel to the plane of rotation of said jaw; and the second jaw of said pair of jaws having contact surfaces which comprise a cylindrical contact surface which is oriented perpendicular to the rail and contact plate at one end of said cylindrical contact surface which is oriented substantially in the plane of rotation of said second jaw.

15. The apparatus claimed in claim 14 in which the first and second faces of the cradle of the first jaw of said pair of jaws include a recess which permits only the upper and lower portions of said faces to contact said spike.

16. Apparatus for holding a railroad spike in a substantially vertically position while said spike is being driven into a railroad tie, said apparatus being mounted in a railroad spiking machine adapted to drive spikes into railroad ties supporting a longitudinally extending railroad rail that is being restrained against longitudinal movement by at least one rail anchor, comprising: a pair of jaws, each jaw pivotally mounted for independent rotation in substantially vertical planes that respectively intersect the vertical plane of said railroad rail to form an included acute angle $\alpha$, said angle $\alpha$ being great enough to avoid interference between said jaws and said anchor when said jaws are rotated out of contact with said spike and said angle $\alpha$ being small enough to impose sufficient mechanical leverage to firmly hold said spike when said jaws are rotated into contact with said spike; means to rotate said jaws relative to said support member and relative to each other; the first jaw of said pair of jaws having a cradle formed therein adapted to receive a spike and further adapted to avoid interference with said spike after said spike has been partially driven into a tie and said first jaw is pivoted out of contact with said spike; and the second jaw of said pair of jaws having contact surfaces adapted to contact said spike so as to force it into said cradle and to firmly hold said spike in said cradle.

17. The apparatus claimed in claim 15 in which said angle $\alpha$ is approximately 45 degrees.

18. The apparatus claimed in claim 15 in which the means to rotate said jaws is comprised of hydraulic cylinders.

19. The apparatus claimed in claim 15 in which the cradle of the first jaw of said pair of jaws is comprised of a first face which is oriented parallel to the rail, a second face which is oriented perpendicular to the rail, and a third face which is oriented substantially parallel to the plane of rotation of said jaw and the contact surfaces of the second jaw of said pair of jaws is comprised of a cylindrical contact surface the axis of which is perpendicular to the rail and a contact plate at one end of said cylindrical contact surface which is oriented substantially in the plane of rotation of said jaw.

20. The apparatus claimed in claim 15 in which said support member is slidably connected to said spike driver by means of a hole in said support member which hole is adapted to receive a vertically oriented slide bar which is fixed to said spike driver.

* * * * *

UNITED STATES PATENT AND TRADEMARK OFFICE

CERTIFICATE OF CORRECTION

PATENT NO. : 4,928,600

DATED : May 29, 1990

INVENTOR(S) : URMSON, Jr., et al

It is certified that error appears in the above-identified patent and that said Letters Patent is hereby corrected as shown below:

Item [57] - Abstract, Line 10, the word "to" is printed twice. Please delete one typing of the word.

Column 8, Claim 6, Line 4: Delete "tot he" and insert-- to the --.

Column 8, Claim 8, Line 1: After "apparatus" insert-- claimed --.

Column 8, Claim 9, Line 1: After "apparatus" insert-- claimed --.

Column 10, Claim 17, Line 1: Delete "Claim 15" and insert-- Claim 16 --.

Column 10, Claim 18, Line 1: Delete "Claim 15" and insert-- Claim 16 --.

Column 10, Claim 19, Line 1: Delete "Claim 15" and insert-- Claim 16 --.

Column 10, Claim 20, Line 1: Delete "Claim 15" and insert-- Claim 16 --.

Signed and Sealed this

Seventeenth Day of September, 1991

*Attest:*

*Attesting Officer*

HARRY F. MANBECK, JR.

*Commissioner of Patents and Trademarks*